US006491621B1

(12) United States Patent
Dykes

(10) Patent No.: US 6,491,621 B1
(45) Date of Patent: Dec. 10, 2002

(54) DOUBLE WALLED DOOR FOR INFANT CARE APPARATUS

(75) Inventor: Christopher A. Dykes, Columbia, MD (US)

(73) Assignee: Datex-Ohmeda, Inc., Madison, WI (US)

( * ) Notice: Subject to any disclaimer, the term of this patent is extended or adjusted under 35 U.S.C. 154(b) by 45 days.

(21) Appl. No.: 09/736,059

(22) Filed: Dec. 13, 2000

Related U.S. Application Data

(60) Provisional application No. 60/182,138, filed on Feb. 12, 2000.

(51) Int. Cl.[7] ..... A61G 11/00

(52) U.S. Cl. ..... 600/22; 312/291; 312/308

(58) Field of Search ..... 600/22, 21; 312/1, 312/291, 308; 392/403; 52/20

(56) References Cited

U.S. PATENT DOCUMENTS 4,936,824 A * 6/1990 Koch et al. ..... 600/22
5,797,833 A * 8/1998 Kobayashi et al. ..... 600/22
5,878,190 A * 3/1999 Gloyd et al. ..... 392/403
6,049,924 A * 4/2000 Prows et al. ..... 5/427
6,234,954 B1 * 5/2001 Mackin ..... 600/22

* cited by examiner

*Primary Examiner*—Charles G. Freay
*Assistant Examiner*—Han Lieh Liu
(74) *Attorney, Agent, or Firm*—Roger M. Rathbun

(57) ABSTRACT

A incubator door having a double walled construction where two parallel walls, an inner and an outer wall are spaced apart to form a passageway therebetween. The inner wall is easily removable from the door for cleaning of the interior of the walls by means of a hinge affixed to the outer wall that holds both of the walls together and which has sockets formed therein. The inner wall has tabs at its bottom that fit into the sockets to hold the bottom of the inner door pivotally to the hinge. There is a slot formed in each of the sockets of a sufficient size to allow the thickness of the inner wall to pass through the slot to be removed from the hinge. The other transverse dimension of the tab is larger and does not pass through the slot. Thus, by pivoting the inner wall so that it aligns with the slot, the inner wall can be readily removed from the outer wall. The upper portion of the inner wall is also held from pivoting by a resilient latch that holds the inner wall in position to the outer wall. The latch is releasable by the user to allow the inner wall to pivot for removal of the inner door. When engaged, the latch firmly holds the upper edge of the inner wall to the outer wall.

9 Claims, 3 Drawing Sheets

DOUBLE WALLED DOOR FOR INFANT CARE APPARATUS

RELATED CASES

The present application is based upon Provisional Patent Application, Ser. No. 60/182,138, filed Feb. 12, 2000.

BACKGROUND OF THE INVENTION

The present invention relates to an infant care apparatus and, more particularly, to an improved means of constructing a double walled door for use with an infant care apparatus.

In the use of infant incubators, there are normally provided, doors, or even sides or ends that are comprised of double walls, that is, the sides or doors are comprised of two generally planar walls that are spaced from each other so that a path is formed between the walls for the passage of heated air.

While the use of such double walled sides or doors are advantageous to provide a passage for the heated air to thus reduce the radiant losses of the infant, there is a problem in the use of that construction in that the double walls must be easily disassembled so that the inner passage for the heated air can be cleaned. Thus, it is important that the double wall construction be structurally strong to maintain the integrity of the particular door or side and yet be easy to be disassembled by the user since the inner surfaces of the walls must be cleaned often by the user.

An example of one of the double walled infant incubators is shown and described in U.S. Pat. No. 4,936,824 of Koch et al. In that patent, there is a double walled door along one lateral side of the infant compartment and the heated air passes up through that door, around the interior of the incubator and downwardly through a double wall at the other lateral side of the incubator. The heated air, therefore, passes through the passageway formed between the double walled construction of the door as well as the other portion of the incubator. Thus, in the Koch et al patent, the heated air is passed from the convective heating system beneath the infant compartment upwardly to pass through the double walls to provide heat to the infant.

Certainly, it can be seen in the Koch et al patent, the passageways that are formed intermediate the double walls of each door can become contaminated and must be cleaned from time to time. As also can be readily appreciated, due to the closeness of the walls, the interior surfaces cannot be effectively cleaned as is and thus, it is necessary to separate the walls by removing one of the walls to effectively carry out that cleaning process.

As such it is very advantageous to have the walls easily separated, without the use of tools or a particularly high level of skill in order to make the cleaning process relatively easy and, of course, it is also of great value to make sure that the walls can be disassembled and reassembled, preferably, without the use of any hardware that has to be removed to minimize the risk of inadvertently misplacing that hardware.

As another example of a double walled incubator construction there is U.S. Pat. No. 4,321,913 of Maluta et al, and which features a pair of cylindrical hood members that are rotated to open and close the hood. In the Maluta et al patent, however, the inner and outer walls are somewhat difficult to align and one wall is removed by removing an end extrusion and sliding one of the walls along a curved recess formed in the end walls. The overall procedure is quite difficult to be carried out, particularly with one person, and thus the removal and cleaning of the Maluta et al incubator hood is a substantial undertaking.

Thus, it would be advantageous to have a double walled incubator construction having a door, side or end that could be easily disassembled and reassembled in order to carry out a cleaning process on the incubator, preferably, incorporating an easy means of removing one of the walls of the double wall construction so as to make the internal surfaces of both the inner and outer wall fully accessible. It would be further advantageous for that incubator to be able to have one of the walls removable without the need to remove any separate hardware that could inadvertently become mislaid and not available for reassembly of the double wall construction.

As used herein, therefore, the description will refer to a door of an incubator, however, it being understood that while a door is preferred for the present double wall construction, the invention may equally apply to the side of the incubator including fixed sides or ends, it being only of importance that one of the walls be easily disassembled from the overall door or side.

SUMMARY OF THE INVENTION

Accordingly, the present invention relates to a double walled door or side that can be used with an infant incubator. As indicated, while there are advantages to the double walled construction having a flow path of heated air therethrough, the double wall construction must be capable of being easily disassembled in order to allow the cleaning of that passageway through the double walls.

In the present invention, therefore, there is a double wall door construction where the inner wall can be held firmly in position with respect to the outer wall so as to provide integrity to the door itself, yet, at the same time, the inner wall can be easily removed from the door assembly to allow the cleaning of the interior surfaces of the inner and outer walls.

In accordance with the present invention, the inner wall is hingedly secured, preferably at its lower edge, to a special hinge having a pair of sockets. In the preferred embodiment, there are two hinges, however, there may be only one hinge used or some number in excess of two. The hinge sockets receive tabs formed at the bottom of the inner wall such that the inner wall can freely rotate while being retained within the sockets. There is a slot in each of the sockets oriented at a particular angular position about the sockets. The slots are sufficiently wide to allow the thickness of the inner wall to pass through the slots to remove the inner wall from the socket and, of course, remove the inner wall from the door assembly itself.

In the preferred embodiment, the slot is formed in the socket at about a right angle to the plane of the assembled double walls, that is, when assembled, the double walls are, obviously, parallel to each other in parallel planes. For removal of the inner wall, therefore, in the preferred embodiment, the inner wall can be rotated about ninety degrees with respect to the plane of the outer wall where the tabs at the bottom of the inner wall line up with the slots in the sockets so that the inner wall can be simply removed from the sockets since the width of the slots is preferably slightly wider than the thickness of that inner wall. Thus, when in the position parallel to the outer wall the length dimension of the tabs is longer than the width of the slots such that the inner wall is held firmly in position and by simply rotating that inner wall a predetermined angular rotation, the inner wall can easily be removed from its affixation to the outer wall.

Obviously, in the assembled position where the two walls are assembled to each other as in use, there needs to be some means to maintain the inner wall in the position parallel to the outer wall and to insure that the inner wall does not inadvertently rotate. Accordingly, further in accordance with the present invention, there are latches that secure the free end, or top end of the inner wall to the outer wall so that the double wall construction is held together for use with the incubator.

Thus, when in use, the walls are held firmly in parallel planes and for removal of the inner wall, it is only necessary to simply unlatch the top of the inner wall to free the inner wall to rotate about its bottom edge, pivotally secured to the outer wall. In the preferred embodiment, that inner wall is rotated about ninety degrees with respect to the outer wall, that is, the plane of the inner wall is moved to a position where it is at a right angle with respect to the plane of the outer wall, then remove the entire inner wall by pulling the tabs through the slots formed in the sockets. Assembly is also simply carried out by reversing the aforedescribed steps.

These and other features and advantages of the present invention will become more readily apparent during the following detailed description taken in conjunction with the drawings herein.

DETAILED DESCRIPTION OF THE INVENTION

Figure 1:
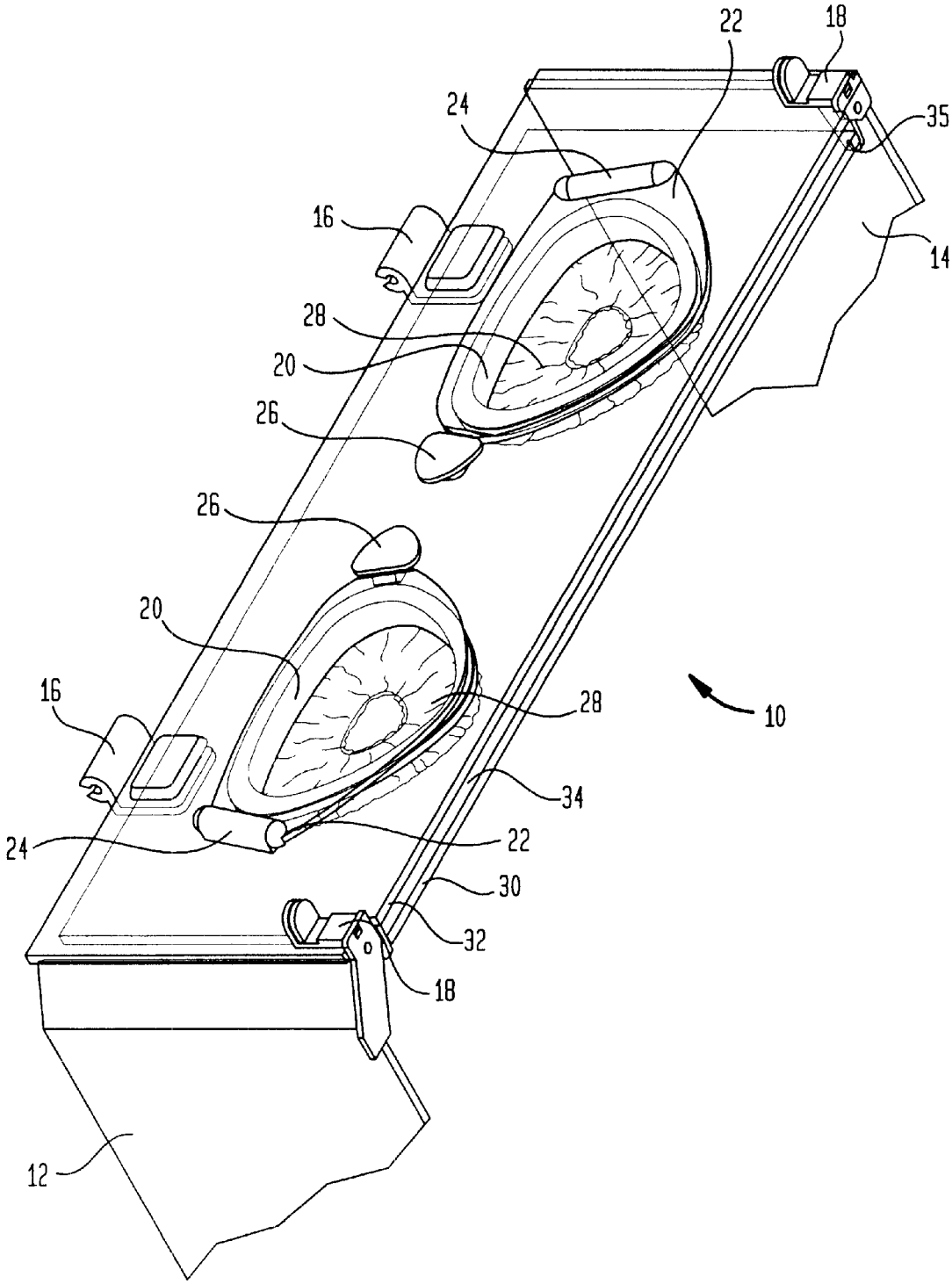
FIG. 1 is a perspective view of a double walled door of an infant incubator constructed in accordance with the present invention.

Referring to FIG. 1, there is shown a view of a door 10 that is used with an incubator and typically is a lateral or side door 10 that is constructed so as to mate with other ends 12, 14 that make up an enclosure for containing an infant. As indicated, a typical incubator is shown and described in U.S. Pat. No. 4,936,824 of Koch et al and the present double walled door 10 can be used with such incubator and the incubator itself will not, therefore, be described here in detail.

In FIG. 1, the door 10 is affixed to an incubator by means of hinges 16 so that the door 10 can be swung downwardly and outwardly to gain access to the infant compartment to carry out an intervention on the infant or to insert and remove an infant from the infant compartment. The door 10 may be secured in its closed position, as shown, by latches 18 that can be manipulated by the user to open and close the door 10.

Also, as is conventional, there are handholes 20 that are used by the attending personnel to gain access to the infant compartment in order to carry out procedures on the infant where it is not necessary to open the entire door 10. The handholes 20 may be covered by handhole doors 22 that are also affixed to the door 10 by handhold hinges 24 and secured in the closed position by handhole latches 26. Wristlets 28 may also be used to surround and seal against the arms of the personnel when attending to the infant.

The door 10, as described, is a double walled door having an inner wall 30 and an outer wall 32 that are constructed so as to be spaced apart and in parallel planes so that a passageway 34 is formed between the walls 30, 32 for the passage of heated air in accordance with the aforementioned Koch et al patent. As a further feature that will later be explained, there is a flexible latch 35 located generally at the top of the door 10 and is firmly affixed to the outer wall, 32 and has a flexible end that captures the inner wall 30. Thus, the upper portion of the inner and outer walls 30, 32 are held together by the latch 35 that is resilient and can easily be flexed by the user to release the inner wall 32 from its attachment with the outer wall 32. In the preferred embodiment, there may be a latch at both lateral sides of the door 10 and both latches can be flexed to release the inner wall 30 from its affixation to the outer wall 32 at the top of the door 10.

Figure 2A:
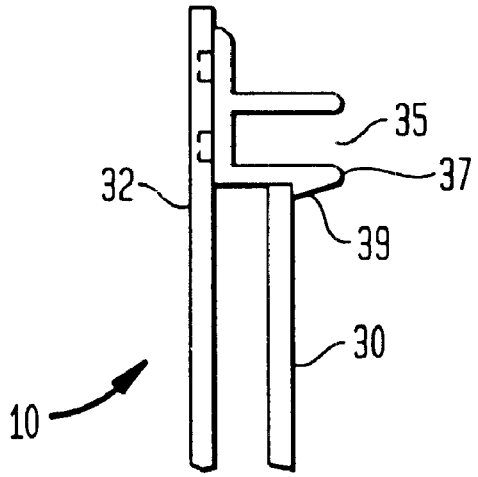
FIGS. 2A and 2B are enlarged side plan views of the latching mechanism located at the top of the inner and outer walls of the present invention.
Figure 2B:
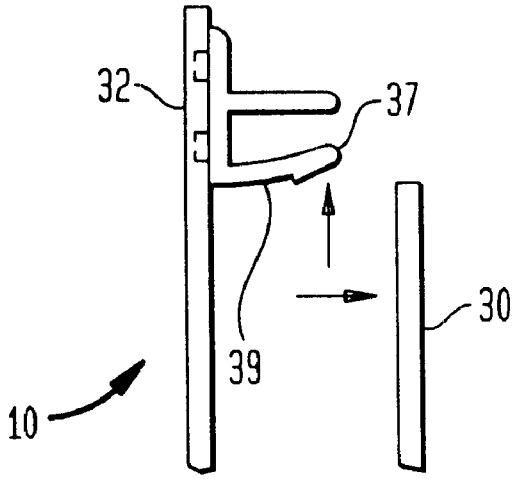

The operation of the latch 35 is shown more clearly in FIGS. 2A and 2B that are enlarged side views of the top of the inner wall 30 and the top area of the outer wall 32. In FIG. 2A, the inner wall 30 is secured to the outer wall 32 and thus is the normal position for the operation of the incubator where the heated air can pass through the passageway 34 to provide warmth to the infant. As can be seen, the flexible latch comprises a flexible arm 37 having a barb 39 formed at the,end thereof to engage the upper edge of the inner wall 30 and thus holds the inner wall 30 captive to the outer wall 32 in a parallel planar relationship.

In FIG. 2B, therefore, the flexible arm 37 has been flexed by the user to disengage the barb 39 from the upper edge of the inner wall 30, thus allowing the inner wall to be moved away from the parallel relationship with the outer wall 32. Thus the flexible latch 35 allows the user to easily latch and unlatch the upper edge of the inner wall 30 with respect to the outer wall 32 simply and without any small components that can need to be separated from the apparatus and which can become lost during the time the inner and outer walls 30, 32 are being cleaned by the user.

Figure 3:
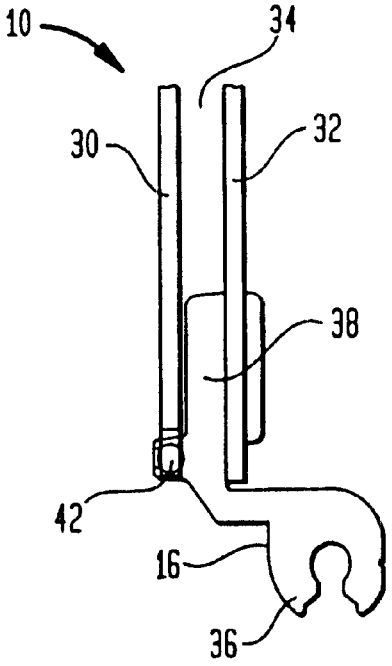
FIG. 3 is an enlarged side view of the double walled door of FIG. 1.

Turning now to FIG. 3, there is shown a partial side view of a door 10 constructed in accordance with the present invention. As can be seen, the hinge 16 has a free end 36 that is adapted to be affixed to the incubator and the hinge 16 also has a spacer 38 that maintains the space between the inner wall 30 and the outer wall 32 with respect to each other to create and maintain the passageway 34 therebetween. The outer wall 32 is firmly affixed to the hinge 16 and the hinge 16 also has sockets 40 formed therein (see FIG. 4) for the spacing and location of the inner wall 30. In the preferred embodiment the hinge 16 is used in the pivotal attachment of the inner wall 30 to the outer wall 32, however, as will be seen, the hinge 16 may be any fixture that can have the structure described herein. Thus, it is preferred that such structure be integrally molded with the actual hinge that affixes the door 10 to an infant apparatus.

In FIG. 3, the inner wall 30 is in its position firmly affixed to the outer wall 32 to make up the completed door 10. In that position there are a pair of tabs 42 (see FIG. 5) that fit into the sockets 40 to hold the bottom of the inner wall 30 to the hinge 16. As can also be seen, however, there is a slot 44 formed in the sockets 40 that, as will be explained, allows the inner door 30 to be easily removed from the hinge 16. The slot 44 is preferably of a sufficient width that is slightly larger than the thickness of the inner wall 30 while the lateral or other dimension of the tabs 42 is larger than the thickness of the inner wall 30.

Figure 4:
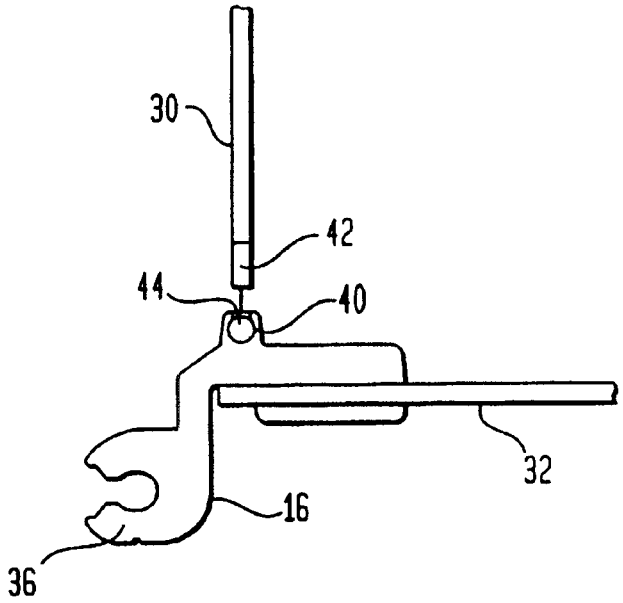
FIG. 4 is an enlarged view of a double walled door of FIG. 1 showing one of the walls separated from the door.

Turning now to FIG. 4, there is shown a view of the door 10 of the present invention with the inner wall 30 removed. To remove the inner wall 30 to the position of FIG. 4, the latch or latches 35 (FIG. 1) can be flexed to release the inner wall 30 and that inner wall 30 can then be rotated or pivoted about the sockets 40 to a position where the thickness of the inner wall 30 is in alignment with the slots 44 such that the tabs 42 can slide through the slots 44 to remove the bottom of the inner wall 30 from the hinge 16.

In the preferred embodiment, the slots 44 are formed at an angle with respect to the plane of the outer wall 32 and that angle is preferably about ninety degrees. Thus, to remove the inner door 30, the inner door 30 is pivoted about the sockets 40 to a position where the inner door 30 is at a right angle with respect to the outer wall 32 and the inner wall 30 can be easily removed for cleaning or the like.

Figure 5:
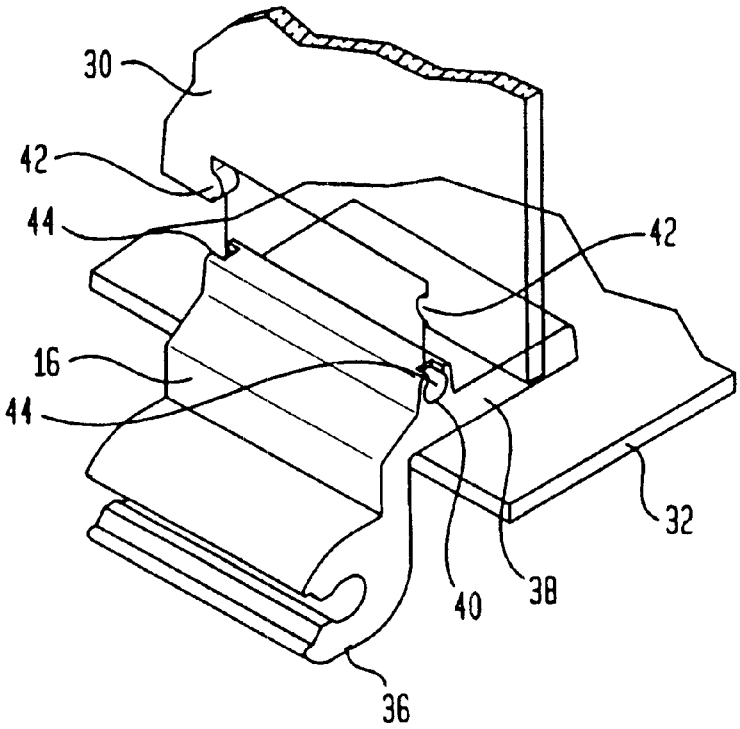
FIG. 5 is a perspective exploded view of the double walled door of the present invention.

Finally, turning to FIG. 5, there is shown a partial exploded view of the mechanism of the present invention. As can be seen, the inner wall 30 is separate or removed from the hinge 16 by the tabs 42 passing through the slots 44. To reinstall the door, obviously, the reverse procedure is used and the inner wall 30 is just as easily reinstalled to the door 10. In the reinstalling of the inner wall 30, as explained, as the inner wall 30 is rotated to its parallel, spaced position with respect to the outer wall 32, the latch or latches 35 (FIGS. 1, 2A and 2B) can flexed automatically to capture the upper portion of the inner wall 30 to retain it in the installed position.

Those skilled in the art will readily recognize numerous adaptations and modifications which can be made to the wristlet attachment means of the present invention which will result in an improved apparatus, yet all of which will fall within the scope and spirit of the present invention as defined in the following claims. Accordingly, the invention is to be limited only by the following claims and their equivalents.

I claim:

1. An incubator door, said door comprising an inner wall and an outer wall, said inner wall having a top and a bottom and at least a pair of tabs extending laterally outwardly at said bottom, at least one structure affixed to said outer wall, said at least one structure having a pair of sockets for receiving said pair of tabs of said inner wall to pivotally secure said bottom of said inner wall to said at least one structure, each of said sockets having a slot formed therein to allow said tabs to pass into and out of said socket only at a predetermined angular position of said inner wall with respect to said outer wall, at least one latch adapted to releasably secure the top of said inner wall to said outer wall, whereby said inner wall can be secured to said outer wall in parallel planar position and can be detached from said outer wall by rotating said inner wall to said predetermined angular position to remove said inner wall from said outer wall.

2. An incubator door as defined in claim 1 wherein said predetermined angular position is about ninety degrees.

3. An incubator door as defined in claim 1 wherein said inner wall has a known thickness and said slots are wider than the known thickness of said inner wall to allow said tabs to pass through said slots.

4. An incubator door as defined in claim 1 wherein each pair of tabs comprises two tabs extending inwardly toward each other.

5. An incubator door as defined in claim 1 wherein said at least one structure comprises two structures.

6. An incubator, said incubator having a base with a door disposed along one side thereof, said door comprising an inner wall and an outer wall, said inner wall having a top and a bottom and at least a pair of tabs extending laterally outwardly at said bottom, at least one structure affixed to said outer wall, said at least one structure having a pair of sockets for receiving said pair of tabs of said inner wall to pivotally secure said bottom of said inner wall to said at least one structure, each of said sockets having a slot formed therein to allow said tabs to pass into and out of said socket only at a predetermined angular position of said inner wall with respect to said outer wall, at least one latch adapted to releasably secure the top of said inner wall to said outer wall, whereby said inner wall can be secured to said outer wall in parallel planar position and can be detached from said outer wall by rotating said inner wall to said predetermined angular position to remove said inner wall from said outer wall.

7. An incubator as defined in claim 6 wherein said at least one structure comprises a hinge adapted to pivotally affix said door to said incubator base.

8. An incubator as defined in claim 7 wherein said inner and outer wall form a passageway therebetween for the flow of heated air.

9. An incubator as defined in claim 8 wherein at least one hinge comprises two hinges.

* * * * *